United States Patent [19]

Rainville

[11] Patent Number: 5,050,299

[45] Date of Patent: Sep. 24, 1991

[54] PROCESS FOR PRODUCING A CAP FLANGE STRUCTURE

[75] Inventor: Gilles A. Rainville, Northridge, Calif.

[73] Assignee: Rockwell International Corporation, El Segundo, Calif.

[21] Appl. No.: 503,578

[22] Filed: Apr. 3, 1990

[51] Int. Cl.[5] ..... B21D 39/03

[52] U.S. Cl. ..... 29/897.32; 29/522.1; 228/118; 228/157

[58] Field of Search ..... 228/155, 157, 118; 29/421.1, 421.2, 522.1, 897, 897.32

[56] References Cited

U.S. PATENT DOCUMENTS

| | | | |
|---|---|---|---|
| 4,220,276 | 9/1980 | Weisert et al. | 228/157 X |
| 4,361,262 | 11/1982 | Israeli | 228/118 |
| 4,509,671 | 4/1985 | Weisert | 228/157 |
| 4,582,244 | 4/1986 | Rainville | 228/118 |
| 4,588,651 | 5/1986 | Israeli | 228/157 X |

FOREIGN PATENT DOCUMENTS

| | | | |
|---|---|---|---|
| 0504146 | 4/1939 | United Kingdom | 29/897.32 |

*Primary Examiner*—Timothy V. Eley
*Assistant Examiner*—C. Richard Martin
*Attorney, Agent, or Firm*—Charles T. Silberberg; Max Geldin

[57] ABSTRACT

Process for producing a cap flange structure, particularly a sinewave I-beam structure comprises joining together a pair of metal sheets in a predetermined area spaced from the opposite outer edge portions of the sheets, and leaving the area between the adjacent sheets along the two opposite edge portions unattached. The joined together portion of the resulting assembly is formed into a sinewave configuration which forms the web of the I-beam structure. The unattached edge portions of the assembly of adjacent sheets is introduced into a die cavity and the die cavity is heated and a gas under pressure is inserted into the area between the sheets of the unattached edge portions, and expanding the sheets of the unattached edge portions into the shape of the die cavity against the wall of the cavity by an accordion expansion without any substantial stretching or thinning of the sheets, while simultaneously moving such sheets in the die cavity. The expanded sheets are trimmed to form a pair of integral flanges along opposite edges of the web of sinewave configuration, to form a sinewave I-beam structure.

18 Claims, 3 Drawing Sheets

FIG. 1
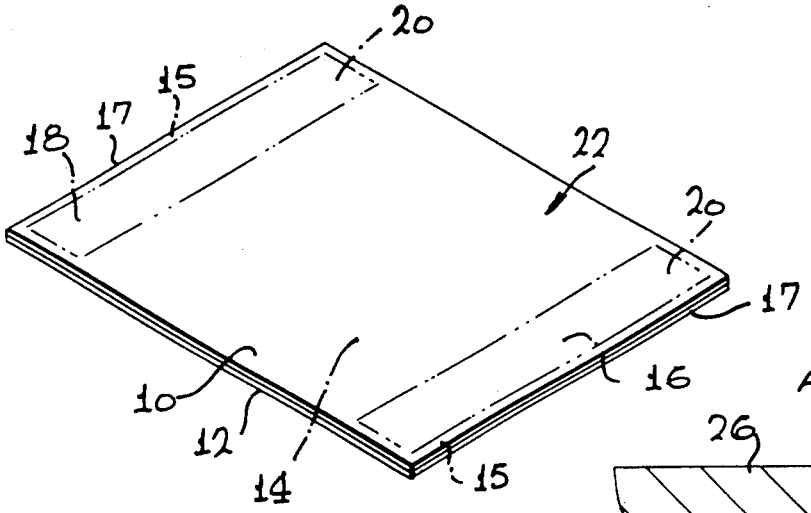
FIG. 2a
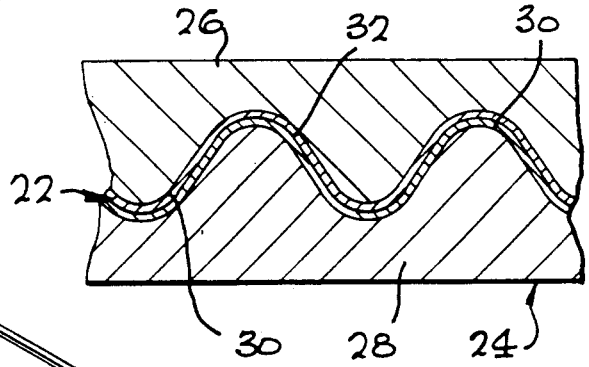
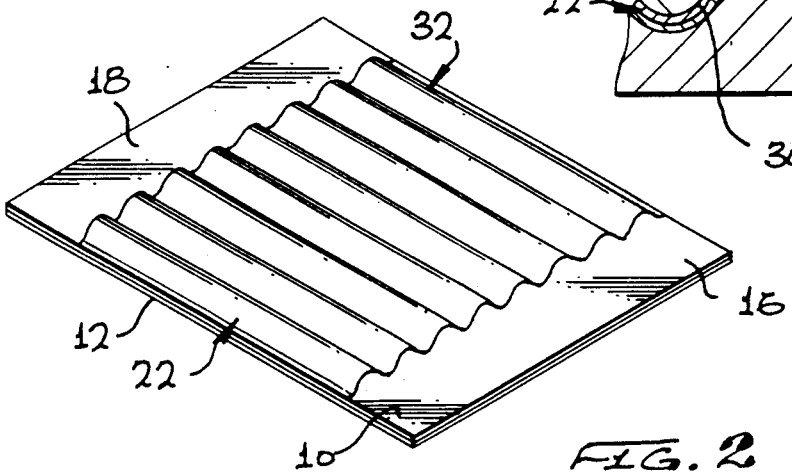
FIG. 2
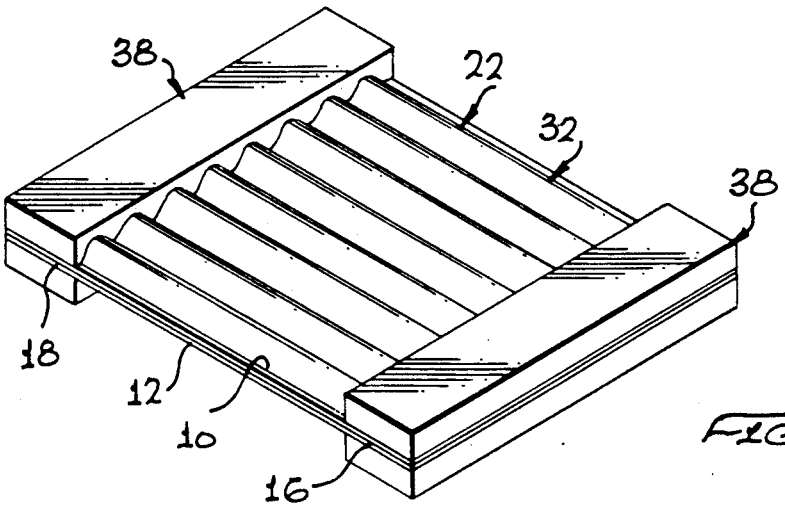
FIG. 3

FIG. 4
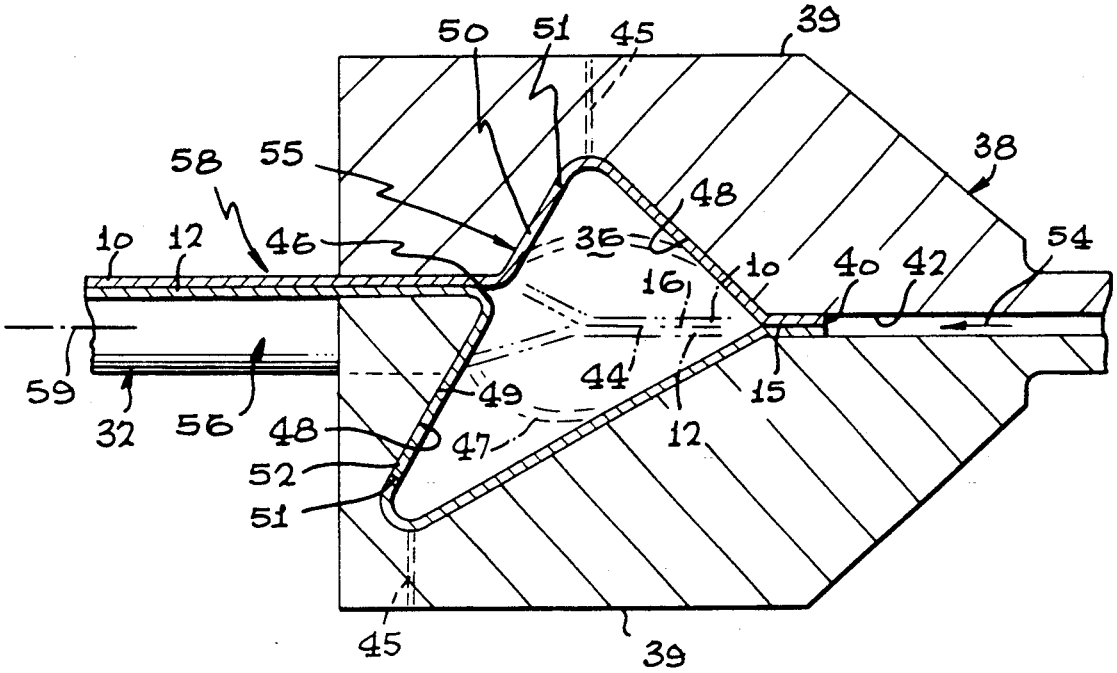
FIG. 5
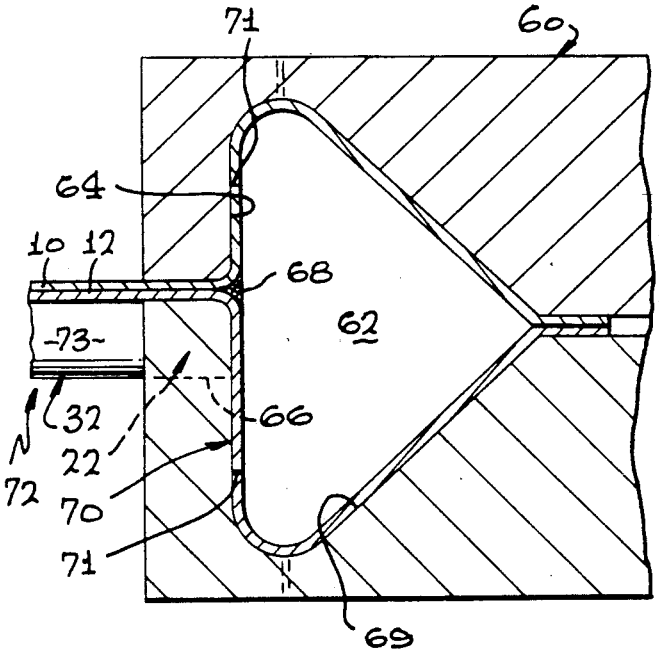
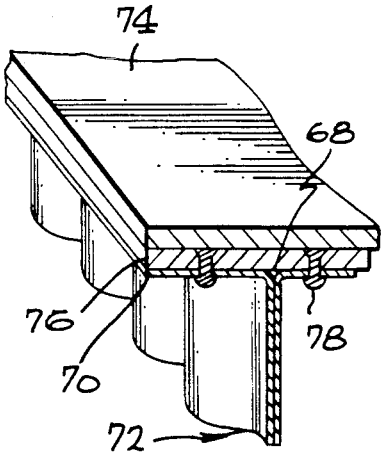
FIG. 6

PROCESS FOR PRODUCING A CAP FLANGE STRUCTURE

BACKGROUND OF THE INVENTION

This invention relates to a process of forming a cap flange structure, and is particularly directed to a process of forming stiffened panel structures, especially sinewave I-beam structures.

The use of complex structures such as cap flange and I-beam structures have been prevalent in the aircraft industry for many years, e.g. in the construction of wings, wall panels, and the like. A particularly useful form of stiffened structure of this nature are sinewave I-beam structures, that is I-beam structures wherein the web between the opposite flanges has a sinewave configuration.

Certain metals and alloys exhibit superplasticity and are capable of being subjected to superplastic forming to produce parts of predetermined shapes. Superplasticity is the capability of a material to develop unusually high tensile elongation with reduced tendency toward local necking during deformation. Prior to such superplastic forming, diffusion bonding of the metal workpieces is carried out to bond the workpieces in certain preselected areas, to permit superplastic forming to be carried out in the unbonded areas of the workpieces.

Examples of metals which can be diffusion bonded and which have superplasticity characteristics include titanium, zirconium, refractory metals, and alloys thereof. Aluminum may also be suitable for this purpose, since recent developments indicate that aluminum and its alloys can be diffusion bonded, as well as being capable of superplastic forming.

Using superplastic forming techniques, and employing a die having a sinewave configuration, a panel or beam having a sinewave shape can be formed. Such structure is to be used as the web for an I-beam, for example, wherein a Tee cap or cap flange is required to be mechanically connected along opposite edges of the web. This type of I-beam structure has the disadvantages of increased weight, and presenting problems in connecting the cap flanges to the web, and the resulting connections between the cap flange and web are often not sufficiently secure and positive connections.

U.S. Pat. No. 4,509,671 to Weisert discloses a method of producing structures having preselected shapes such as T-caps by diffusion bonding and superplastic forming.

U.S. Pat. No. 4,361,262 to L. Israeli, discloses a process that may be used as a substitute for superplastic forming. The process is called "accordion expansion" and essentially involves the unfolding of core sheets with a minimal amount of expanding. The formed sandwich structures generally have a vertical core that is linear and flat, although angled core is also possible. To form such structures only about 10% expansion is required. Since almost all metals will expand 10% without a significant loss of strength at elevated temperatures, accordion expansion is not limited to superplastic materials. A major advantage of accordion expansion is that forming can occur at temperatures and pressure differentials significantly lower than superplastic forming.

U.S. Pat. No. 4,582,244 to Rainville discloses a method for forming sine wave I-beams employing diffusion bonding and superplastic forming.

U.S. Pat. No. 4,588,651 to Israeli discloses a method of forming complex structures such as sandwich structures employing an accordion expansion process.

It is an object of the present invention to provide a novel process for producing a cap flange structure.

Another object of the invention is the provision of a process for producing a cap flange structure wherein the cap flange is integrally mounted on a supporting web.

Yet another object is to provide a process for producing an I-beam structure wherein opposite flanges are integrally mounted on the web of the I-beam.

A still further object is to provide procedure for producing an I-beam structure having a web of sinewave configuration, and wherein the flanges along opposite edges of the web are integrally attached thereto by accordion expansion.

Still another object is the provision of procedure for producing the above-noted sinewave I-beam structure wherein the flanges are mounted at an angle of 90° or other than 90° to the central plane of the web.

Other objects and advantages of the invention will appear hereinafter.

SUMMARY OF THE INVENTION

According to the concept of the invention process, a cap flange structure is produced by providing a pair of metal workpieces bonded together in at least one predetermined area, leaving at least one area between the workpieces and adjacent an outer edge thereof unbonded. The unbonded portions of the resulting assembly of workpieces is inserted into a die, and the die is heated. A gas under pressure is introduced into the die and into the unbonded area between the workpieces, simultaneously moving the workpieces within the die and expanding the workpieces into the shape of the die by accordion expansion, without any substantial stretching or thinning of the workpieces during such expansion. The expanded workpieces within the die are trimmed to form the desired cap flange structure on a web formed by the bonded workpieces.

According to a preferred feature of the invention, following bonding of the workpieces in a predetermined area the bonded portion of the workpieces is subjected to formation of a sinewave configuration prior to insertion of the workpieces into the die. Also, preferably areas between the workpieces along both edges thereof are left unbonded and both of such edge portions containing the unbonded areas of the workpieces are inserted into a pair of dies and subjected to accordion expansion therein. The expanded portions of the workpieces in both dies are trimmed, forming a cap flange structure along opposite edges of a web, preferably of sinewave configuration.

The unbonded edge portions of the assembly of workpieces can be subjected to accordion expansion as described above wherein the cap flanges are at an angle of 90° or an angle other than 90° to the web, e.g. sinewave web, formed by the bonded workpieces.

The invention process results in an I-beam structure having cap flanges or flanges integrally connected to a web, preferably of sinewave configuration, and which has increased strength and stiffness, particularly as a result of the accordion expansion step for forming the cap flanges, which takes place without any substantial stretching or thinning of the material forming the cap flanges.

BRIEF DESCRIPTION OF THE DRAWINGS

The invention will be more readily understood by reference to the detailed description below of certain preferred embodiments taken in connection with the accompanying drawings wherein:

FIGS. 1, 2 and 3 illustrate the three steps of the invention process for producing a sinewave I-beam structure according to the invention, including bonding together a pair of workpieces in an intermediate area between opposite edge portions, forming a sinewave configuration in the bonded portion of the workpieces and subjecting the unbonded edge portions of the assembly of workpieces to accordion expansion according to the invention, to form the flanges integrally connected to the sinewave web portion;

FIG. 2*a* illustrates formation of the sine wave web portion indicated in FIG. 2, employing a die and superplastic forming;

FIG. 4 illustrates accordion expansion of the unbonded edge portions of the assembly illustrated in FIG. 2, in an appropriate die to form the flanges of the sinewave I-beam, as indicated in FIG. 3, wherein the cap flanges are formed at an angle other than 90° to the web;

FIG. 5 is a showing similar to FIG. 4, wherein the cap flanges are formed at a 90° angle to the web;

FIG. 6 illustrates use of the sinewave I-beam of FIG. 5 for connection as to the skin of an aircraft;

DETAILED DESCRIPTION OF THE INVENTION AND PREFERRED EMBODIMENT

Figure 7:
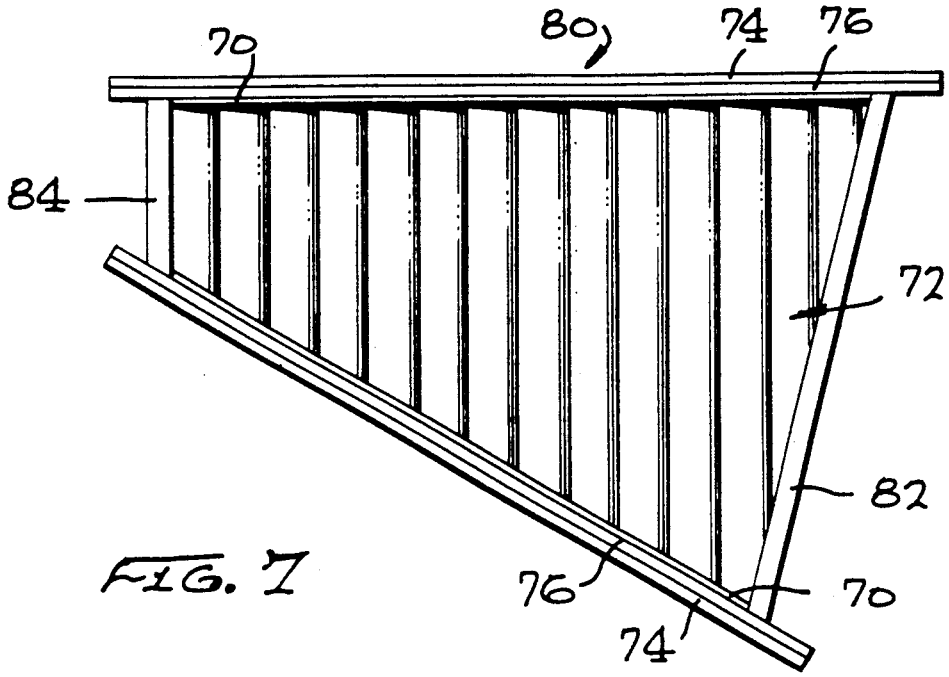
FIG. 7 illustrates use of a sinewave I-beam produced according to the invention process in a bulkhead construction.

As illustrated in FIGS. 1, 2 and 3, the invention process briefly comprises bonding two flat sheets together in a certain predetermined area, leaving two non-bonded area edge portions to eventually form the flanges of the beam. The bonded portion of the sheet assembly is formed into a sinewave structure, and the non-bonded edge portions are inflated and pressurized inside a pre-shaped die and bent therein by accordion expansion. The inflated and bent non-bonded portions in the die are then trimmed to form the cap flanges on the sinewave I-beam.

Referring first to FIG. 1, a pair of workpieces or sheets 10 and 12 are initially bonded together in an intermediate or central area 14, and in a narrow strip 15 along both opposite edges 17, leaving essentially the outer edge portions 16 and 18 between bonded portions 14 and 15 unbonded in the areas 20 between the adjacent sheets of such edge portions.

A wide variety of materials may be used for the sheets 10 and 12 which include, but are not limited to, aluminum, titanium and copper, and their respective alloys, as well as plastics, composites and steel. The preferred embodiment uses aluminum, titanium, and their alloys, joined by known bonding procedures in central area 14, such as by welding or diffusion bonding. Where diffusion bonding is used for joining the workpieces 10 and 12 in areas 14 and 15, the areas 20 between the workpieces of the outer edge portions 16 and 18 which are not to be joined, are separated by a known stop-off material or maskant (not shown), such as yttria, which is applied in a suitable binder by a silk screening process.

For carrying out diffusion bonding to form the bond in the central area 14 between the adjacent workpieces, the assembly is heated to a suitable diffusion bonding temperature, e.g. about 1700° F. for (Ti-6A1-4V) by heat generated from heating platens (not shown), while pressure, e.g. ranging from about 150 to about 600 psi is applied.

The resulting bonded area 22 of the assembly of workpieces is then subjected to a process to form the bonded area into a sine wave configuration, as illustrated at 32 in FIG. 2. Various procedures known in the art can be employed for this purpose. One such known procedure is roll bonding. Other procedures include weld bonding, organic adhesive bonding and diffusion bonding.

Another preferred procedure for this purpose is superplastic forming. According to one mode of procedure using this technology, referring to FIG. 2*a*, a two piece die 24 is used having opposed male and female portions 26 and 28, each having a matching sinewave configuration 30. The bonded portion 22 of the assembly of workpieces is placed in the die 24 and the die is heated to superplastic forming temperature, e.g. 1650°-1750° F. for 6A1-4V titanium alloy and the die portions 26 and 28 are subjected to pressure, e.g. of about 200 to about 400 psi to cause the sheets in the bonded portion 22 to stretch and assume a sinewave configuration, as indicated at 32 in FIG. 2*a*.

Alternatively, in place of employing a two piece die 24, a die having only a male portion 26 of sinewave configuration 30 can be employed in conjunction with an adjacent die cavity (not shown), and an inert gas such as argon or helium can be passed into such cavity to cause the bonded area 22 of the assembly of workpieces to expand and stretch into contact with the sinewave shape of the male cavity 26, and form the bonded area 22 of the assembly into the sinewave configuration 32.

Further, if desired, both the diffusion bonding at 14 and the superplastic forming of the bonded area 22 into a sinewave configuration can be carried out simultaneously in the die 24 of FIG. 2*a*.

Referring now to FIG. 3, the unbonded portions 16 and 18 of the assembly shown in FIG. 2, and containing the central or intermediate bonded area 22 now having a sinewave configuration 32, are placed in opposing tool dies indicated at 38 for inflation of such unbonded areas to shape them into opposite like flanges or cap flanges, as described below.

Viewing FIG. 4, with respect to one of the unbonded edge portions 16, this procedure is carried out by inserting the unbonded edge portion 16 into the cavity 36 shown as substantially triangular in shape, of a tool 38 having split die portions 39, the outer end 40 of the unbonded edge portion 16 being received in a longitudinal cavity 42 at the opposite end of the tool, which permits only longitudinal movement of the workpieces 10 and 12 of the unbonded edge portion 16.

The die 38 is heated at a suitable temperature to accomplish accordion expansion, e.g. 1250° to 1700° F. for 6A1-4V titanium, and pressurized gas such as argon at between 100 and 500 psi is introduced and circulated through the space or passages 44 between the unbonded workpieces 10 and 12 of edge portion 16, the edge bond 15 preventing outward escape of the gas. As the gas is introduced between the workpieces, air in the die is forced out through vent holes 45 in the die, or by application of a vacuum. The applied pressure between workpieces 10 and 12 will cause the unbonded sheets 10 and 12 in cavity 36 to expand and move away from each other, and to bend and balloon out, as indicated at 47, about the joined edge 46 of the sheets, and against the entire inner wall 48 of the triangular cavity 36. During such expansion of the unbonded workpieces 10 and 12, the workpieces are simultaneously moved in the direction indicated by arrow 54 within the longitudinal cavity 42, resulting in an accordion expansion of the unattached workpieces 10 and 12 against the wall 48 of the die, without any substantial stretching or thinning of such sheets.

It is noted that sufficient unattached or unbonded sheet material of the workpieces is present within the longitudinal cavity 42 to enable the sheet material to slide through the die cavity and bend to the shape of the triangular die cavity as noted above. Only minimal stretching of the order of about 10% occurs during accordion expansion and resulting in corresponding minimal thinning of the expanded sheets 10 and 12. Following accordion expansion, the workpieces 10 and 12 adjacent the front wall 49 of the cavity are trimmed at their outer edges 51, the resulting trimmed workpieces 50 and 52 forming the cap flange 55 integrally connected to the web 56 of sinewave configuration formed in the bonded area 22, resulting in the sinewave I-beam 58.

It will be noted that the opposite unbonded edge portion 18 of the assembly shown in FIG. 2 is likewise inserted into a second tool 38, as indicated in FIG. 3, and the accordion expansion of the unbonded edge portion 18 can be simultaneously accordion expanded together with accordion expansion of the unbonded edge portion 16, as described above, or unbonded edge portion 18 can be accordion expanded in the same tool 38 used for accordion expansion of unbonded edge portion 16 following such expansion thereof. The resulting structure is a sinewave I-beam structure 58 having cap flanges 55 integrally mounted along opposite edges of the I-beam.

It will be noted that the cap flanges 55 formed in the tool of FIG. 4 are at acute and obtuse angles to the central plane 59 of the web along the opposite edges of the sinusoidal web 56 of the I-beam. However, as illustrated in FIG. 5, the cap flanges on the sinewave I-beam can be disposed at an angle of 90° to the central plane of the I-beam. Accordingly, it is clearly apparent that the cross section of the cap flange structure according to the present invention can comprise a cap flange at an angle of 90° or other than 90° to the web of the I-beam.

Referring to FIG. 5, it is seen that the tool 60 has an essentially triangular cavity 62 having a front wall 64 which is at a 90° angle to the cavity 66 which receives the bonded portion 22 of sinewave configuration 32. Hence, upon accordion expansion of the sheets 10 and 12 of the unbonded edge portion 16, as described above with respect to FIG. 4, the sheets 10 and 12 expand outwardly around the weld 68 at the inner end of the bonded portion 22, into engagement with the triangular wall 69 of the cavity and are trimmed or cut at their outer ends 71 along the front wall 64 of the cavity to form a cap flange 70 disposed at a 90° angle to the web 73 of the resulting sinewave I-beam 72.

FIG. 6 illustrates an example of the application of the sinewave I-beam 72 of FIG. 5. Thus, the cap flange 70 of I-beam 72 is connected to the thermoplastic skin 74 of an aircraft. This is accomplished by first bonding a thermoplastic cap 76 to the skin 74 and also to the flange 70 of the I-beam 72. Rivets 78 are also used to form a positive bond between the I-beam flange 70 and the cap 76. The cap 76 is used to aid in carrying additional loads. It should be understood of course that the skin 74 and cap 76 can be materials other than thermoplastics, such as a graphite cap, aluminum or titanium or any other material employed in aircraft construction.

Referring now to FIG. 7 there is shown the application of the arrangement illustrated in FIG. 6, to form a bulkhead 80 in which the caps 76 are linked by the sinewave I-beam 72. In this embodiment, it is noted that the cap flange 70 along the upper and lower edges of the I-beam are at angles other than 90° to the I-beam 72 along the length thereof, to match the corresponding angles of the skin 74 to which the bulkhead is attached. End members 82 and 84 are provided connecting the opposite thermoplastic caps 76 and skins 74.

Figure 8:
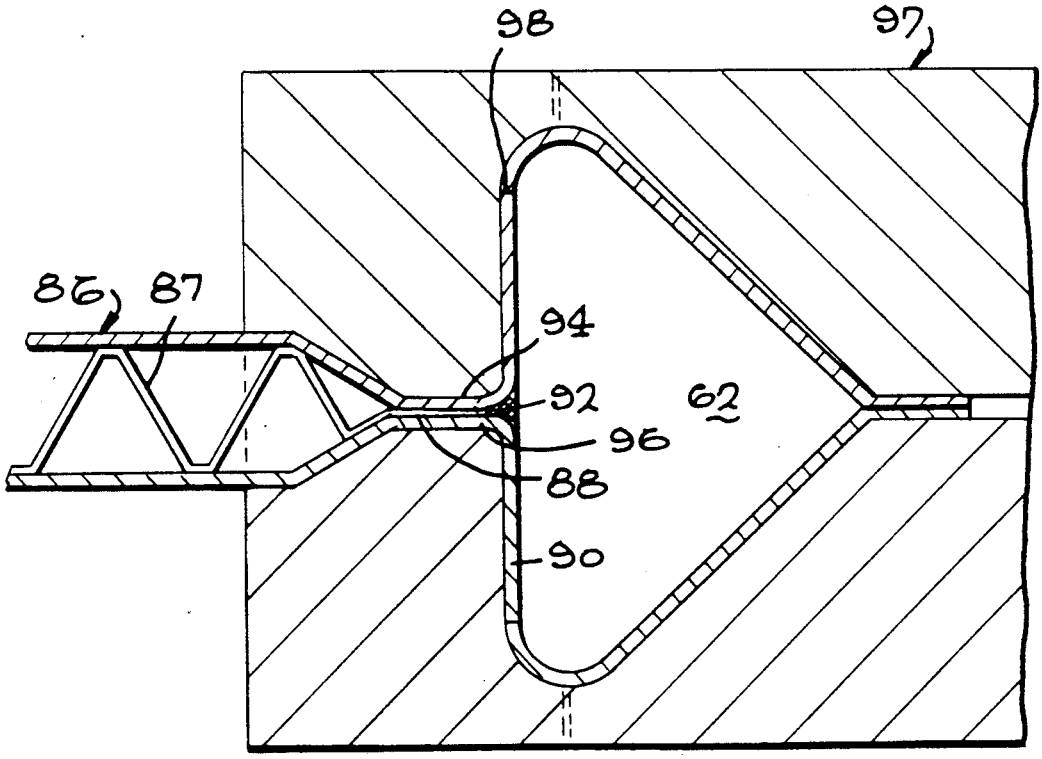
FIG. 8 is a showing similar to FIG. 4, illustrating use of the invention process for forming an integral cap flange on a truss core sandwich structure.

Now viewing FIG. 8, there is shown the application of the accordion expansion principle for integrally connecting a flange to a structure other than an I-beam or a sinewave I-beam. Thus, viewing FIG. 8 there is shown a truss core sandwich structure 86 having a core 87 and a neck portion 88 to which is integrally connected a cap flange 90 around a weld 92 formed between the sheet members 94 and 96 of the neck portion 88. The flange 90 is formed by accordion expansion of sheet members 94 and 96 within the cavity 62 of a tool 97, around the weld 92, and cut at its outer ends 98, as described above with respect to the embodiment of FIG. 4, and similar to the embodiment shown in FIG. 5.

From the foregoing, it is seen that the present invention provides a relatively simple procedure for producing a flange or cap flange integrally mounted on a cap flange structure, employing the concept of accordion expansion in the formation of such cap flange structures, and is particularly applicable for producing sinewave I-beam structures, especially applicable for use in the aircraft industry.

Since various changes and further modifications of the invention will occur to and can be made readily by those skilled in the art without departing from the invention concept, the invention is not to be taken as limited except by the scope of the appended claims.

What is claimed is:

1. A process for producing a cap flange structure which comprises providing a pair of metal workpieces bonded together in at least one predetermined area, leaving at least one area between said workpieces and adjacent an outer edge thereof unbonded, inserting said at least one unbonded area of the resulting assembly of workpieces into a die, heating the die and introducing a gas under pressure therein and into said at least one unbonded area between said workpieces, simultaneously moving said workpieces by the gas pressure within said die and expanding said workpieces into the shape of the die by accordion expansion, sufficient unbonded material of said workpieces being present in the die to enable the workpieces to slide in the die and bend to the shape of the die during said accordion expansion, and trimming the expanded workpieces to form the desired cap flange structure on a web having a central plane and formed by the workpieces bonded in said at least one predetermined area.

2. The process of claim 1, including the step of subjecting the bonded workpieces in said at least one predetermined area to formation thereof into a sinewave configuration prior to insertion of said assembly of workpieces into said die.

3. The process of claim 2, wherein there are two said unbonded areas between said workpieces adjacent opposite outer edges thereof and wherein both of said unbonded areas of the resulting assembly of workpieces are each inserted into a die and subjected to said accordion expansion therein, said trimming of the expanded workpieces forming a cap flange structure along opposite edges of the web formed by the workpieces bonded together in said at least one predetermined area.

4. The process of claim 3, including the step of subjecting the bonded area of said workpieces to formation thereof into a sinewave configuration prior to insertion of the unbonded edge portions of said workpieces into the die, and forming an I-beam having cap flanges and a web of sinewave configuration.

5. The process of claim 4, wherein the cross section of the I-beam comprises a pair of opposite cap flanges at an angle of 90° or other than 90° to the web of the I-beam.

6. The process of claim 1, wherein said workpieces are composed of a metal having superplastic forming characteristics.

7. The process of claim 1, wherein said workpieces are composed of aluminum or titanium, or an alloy thereof.

8. The process of claim 1, wherein the workpieces are in the form of sheets and the cap flange is formed along at least one edge of the web formed by the sheets bonded together in said at least one predetermined area.

9. The process of claim 1, wherein the cross section of the cap flange structure comprises a cap flange at a 90° angle to the central plane of the web formed by the bonded area of the workpieces.

10. The process of claim 1, wherein the cross section of the cap flange structure comprises a cap flange at an angle other than 90° to the central plane of the web formed by the bonded area of the workpieces.

11. A process for producing a sinewave I-beam structure which comprises joining together a pair of metal sheets having opposite outer edge portions in a predetermined intermediate area spaced from said opposite outer edge portions, and also joining together said sheets in a narrow area closely adjacent both edge portions of said sheets, leaving most of the area between the adjacent sheets along the two opposite edge portions unattached, forming the joined together intermediate area portion of the resulting assembly of metal sheets into a sinewave configuration comprising the web of an I-beam structure, said web having a central plane, introducing the unattached edge portions of the assembly of adjacent sheets into a die cavity, heating the die cavity and introducing a gas under pressure into the area between the sheets of the unattached edge portions, expanding the sheets of the unattached edge portions into the shape of the die cavity against the wall of the cavity by an accordion expansion and simultaneously moving the sheets of said unattached edge portions by the gas pressure in said die cavity, sufficient unattached material of said sheets being present in the die cavity to enable the sheets to slide through the die cavity and bend to the shape of the die cavity during said accordion expansion, and trimming the expanded sheets to form a pair of integral flanges along opposite edges of said web of sinewave configuration.

12. The process of claim 11, said metal sheets being joined together in said predetermined intermediate area and in said narrow area by diffusion bonding.

13. The process of claim 11, said forming of said joined together intermediate area portion of said metal sheets into a sinewave configuration being carried out by superplastic forming or by roll forming.

14. The process of claim 11, wherein the two opposite outer edge portions containing the unattached area between adjacent sheets are successively introduced into the die cavity for accordion expansion therein and trimming to successively form said pair of flanges along opposite edges of said web.

15. The process of claim 11, wherein the two opposite outer edge portions containing the unattached area between adjacent sheets are introduced simultaneously into separate die cavities for accordion expansion therein and trimming to simultaneously form said pair of flanges along opposite edges of said web.

16. The process of claim 11, wherein the cross section of one or both of said pair of flanges are at an angle of 90° to; the central plane of the web of the I-beam.

17. The process of claim 11, wherein the cross section of one or both of said pair of flanges are at an angle other than 90° to the central plane of the web of the I-beam.

18. The process of claim 11, including incorporating said sinewave I-beam structure between skins of an aircraft component, and connecting the flanges of said I-beam to said skins.

* * * * *